US006686537B1

(12) United States Patent
Gareis et al.

(10) Patent No.: US 6,686,537 B1
(45) Date of Patent: Feb. 3, 2004

(54) HIGH PERFORMANCE DATA CABLE AND A UL 910 PLENUM NON-FLUORINATED JACKET HIGH PERFORMANCE DATA CABLE

(75) Inventors: Galen M. Gareis, Richmond, IN (US); Gregory J. Deitz, Richmond, IN (US)

(73) Assignee: Belden Wire & Cable Company, Richmond, IN (US)

( * ) Notice: Subject to any disclaimer, the term of this patent is extended or adjusted under 35 U.S.C. 154(b) by 0 days.

(21) Appl. No.: 10/031,732

(22) PCT Filed: Jun. 14, 2000

(86) PCT No.: PCT/US00/16344

§ 371 (c)(1),
(2), (4) Date: May 23, 2002

(87) PCT Pub. No.: WO01/08167

PCT Pub. Date: Feb. 1, 2001

Related U.S. Application Data

(60) Provisional application No. 60/144,998, filed on Jul. 22, 1999.

(51) Int. Cl.[7] ..... H01B 7/00; H01B 7/34

(52) U.S. Cl. ..... 174/36; 174/110 R; 174/113 R

(58) Field of Search ..... 174/36, 102 R, 174/102 C, 103, 110 R, 113 R, 102 SP, 105, 108

(56) References Cited

U.S. PATENT DOCUMENTS 3,843,829 A * 10/1974 Bridges et al. ..... 174/36
4,096,346 A * 6/1978 Stine et al. ..... 174/36
4,860,343 A * 8/1989 Zetena, Jr. ..... 379/110.01
5,486,649 A * 1/1996 Gareis ..... 174/36
5,574,250 A * 11/1996 Hardie et al. ..... 174/36
5,744,757 A * 4/1998 Kenny et al. ..... 174/113 R
5,767,442 A * 6/1998 Eisenberg et al. ..... 174/36
5,956,445 A * 9/1999 Deitz et al. ..... 385/100
6,403,887 B1 * 6/2002 Kebabjian et al. ..... 174/110 R

* cited by examiner

*Primary Examiner*—William H. Mayo, III
(74) *Attorney, Agent, or Firm*—James B. Conte; Barnes & Thornburg

(57) ABSTRACT

We provide a high performance bound lateral shielded twisted pair cables, a high performance data cable containing at least four of the bound lateral shielded twisted pair cables, and a method for preparing the same. The bound lateral shielded twisted pair cables preferably have a 20° C. adjusted standard impedance deviation of 4.5 or less and the high performance data cable contains at least four of the bound lateral shielded twisted pair cables and has a 20° C. adjusted average standard impedance deviation of 4.5 or less. The twisted pair is laterally wrapped with a metal shield tape and a fabric or metal braid or thread at a tension that provides the above. The tension is such that it provides a cross-sectional void area of less than 25% and preferably less than 18% of the lateral shielded twisted pair cable cross-sectional area. The tape is laterally wrapped with an overlap of at least 10% . Preferably, the cables have a rating out to 600 MHz and 1000 MHz. We also provide a UL 910 plenum at least category 5 high-performance data cable that has a non-fluorinated jacket and between the jacket and cable core, a temperature-resistant flame-retardant separator tape.

21 Claims, 2 Drawing Sheets

HIGH PERFORMANCE DATA CABLE AND A UL 910 PLENUM NON-FLUORINATED JACKET HIGH PERFORMANCE DATA CABLE

This application is a 371 of PCT/US00/16344, filed Jun. 14, 2000 and claims the benefit of provisional application 60/144,998, filed Jul. 22, 1999.

FIELD OF THE INVENTION

This invention relates to high performance data cables that successfully enables transmission in the frequency range of 0.3 MHz to 1200 MHz and especially in the range of 1.0 to 600 MHz and/or 1.0 to 1000 MHz. Also to UL 910 high-performance plenum cables that have a non-fluorinated jacket. More particularly, the invention relates to high-performance data cable which are bound-lateral shielded twisted pair cables. Also, this relates more particularly to the at least category 5 plenum UL 910 cables having a non-fluorinated jacket and a heat-resistant flame-retardant tape on the inner circumference of the jacket.

BACKGROUND OF THE INVENTION

The current high performance data cables usually utilize as a shield a heavy, stiff, 2 mil aluminum tape with a 1 mil polyester (Mylar) backing. The shield is wrapped around each unshielded twisted pair subgroup within an application lay length that is equal to the length of the cables overall cable lay, typically lays of 4.0 to 6.0 inches. The tape is about 0.5 inches wide. The application angle of the wrapping is shallow, based on the long overall cable lay (5 inches) and the tape is almost parallel with the twisted pair laterally axis. A typical cable has 4 pairs of twisted pair cables with a 40 to 65% tinned copper. braid applied over the four pairs and a final thermoplastic jacket extruded over the braided pairs to complete the cable. The shallow application angle of the metal shield tape generally creates the problem of allowing the tape to open up during the cabling operation before a binder or spirally applied drain wire can capture it.

Also, the tape doesn't generally follow the pairs contour under the tape. Tape gaps are created with this process around the unshielded twisted pair core that do not provide a sufficiently stable ground plane to meet the industry standard electrical requirements such as CENELEC pr EN 50288-4-1.

The known cable structure noted above is mechanically unsound in a static state, and the electricals are unstable under installation conditions since the single overall braid cannot adequately insure the tape lap doesn't "flower" open when the cable is flexed. This "flowering" increases NEXT, and further erodes impedance/RL performance as the ground plane is upset. This adds to attenuation non-uniformity. The impedance numbers are even worse under flexing since the conductor's center to center, as well as the ground plane, changes. The higher the bandwidth requirement, the worse these issues become.

We know of no cable structure for high performance UL 910 plenum data cables that have a non-fluorinated jacket. A plenum cable that used a fluorinated jacket and a temperature-resistant flame-retardant separator tape such as Nomex® (a temperature-resistant flame-retardant nylon manufactured by DuPont) was used and sold by Belden Wire & Cable Company more than a year prior to this invention. The Nomex® tape in those cables kept the fluorinated (FEP) jacket from dripping and producing high peak smoke numbers in the UL 910 burn test.

SUMMARY OF THE INVENTION

Our invention uses on each twisted pair cable a lateral wrapped shielding tape that is bound with a fabric or metal binder to meet impedance/RL, attenuation uniformity, and capacitance unbalance that is required.

Our invention eliminates most of the trapped air that is normally found in shielded twisted pair cables. This is done by utilizing a lateral wrapped shield with preferably a minimum 10% overlap and which has a 0.33 to 2.0 mil and preferably a 1 mil metal layer. The lateral wrapped shield is held together by an appropriate binder and preferably by a textile or metal braid or textile helically wrapped thread to provide good shielding with improved impedance control. When desired, a short fold can be applied along the lateral seam of the shield for improved EMI/Rfi isolation. The consistent ground plane created along the cables length allows better capacitance unbalance as well as improved attenuation uniformity through the reduction of RL reflections and capacitance unbalance.

Our invention also provides for substantial geometric stability under flexing. The use of a tight lateral shield with at least a 10% overlap and a textile or metal binder, eliminates tape gaps and flowering under flexing. This establishes a very stable level of physical and electrical performance under adverse use conditions. Our twisted pair cable center to center distances indicated as (d) in FIG. 3, and conductor to ground distances, remain much more stable than those of the previous cables.

Our cables are especially beneficial for use as category 7 and higher performance cables. This is especially true for those cables that we laterally shield and bind and are used out to 600 MHz or 1000 MHz. The typical high-performance data cable when made according to our invention, has four (4) twisted pair cables with each twisted pair cable made up of two foam or non-foam insulated (fluorocopolymer or polyolefin) singles. Each of the twisted pair cables has the unique tight lateral metal shield tape wrapped around it with the tape and its lateral short fold seam tightly held in place with a tight binder such as a fabric or metal braid or a helical thread. When a braid is used as the binder, it is a 40 to 95% braid. When a thread is used, it is preferably helically wound. The bound-lateral shielded pairs are S-Z'd or planetary together into a bunched or bundled configuration. The bundled pairs may be bundled by an overall 40 to 95% braid or thread. A final thermoplastic jacket (fluorocopolymer or a polyolefin or polyvinyl chloride) is extruded over the bundled twisted pair cables.

Generally the metal shield is an aluminum tape or a composite tape such as a short fold BELDFOIL tape (this is a shield in which metal foil or coating is applied to one side of a supporting plastic film), or a DUOFOIL tape (this is a shield in which the metallic foil or coating is applied to both sides of a supporting plastic film) or a free edge BELDFOIL tape. The overall metal thickness is 0.33 to 2.0 mil aluminum layer thickness and preferably about a 1.0 mil. Although aluminum is referred to, any suitable metal normally used for such metal and composite metal tapes can be used such as copper, copper alloy, silver, nickel, etc. Each twisted pair is wrapped with the metal facing outwardly and although the most preferred wrap is about a 25% overlap, the overlap may vary as a practical matter from 10 to 50%. The preferred shield that gives the best attenuation and impedance characteristics are those tapes that are joined to provide a shorting effect. However, with a suitable overlap, the short fold can be eliminated.

The number of shielded twisted pairs in a high performance data cable is generally from 4 to 8 but may be more if desired. The tension of the laterally wrapped shield and the binder are such that the wrapped shield and binder eliminate most of the air to provide a standard impedance deviation for the bound-laterally shielded twisted pair cable and an average standard impedance deviation for the high performance data cable which has a plurality of laterally shielded twisted pairs. The tension on the shielding tape and binder are such that there is only a 25% or less and preferably 18% or less void space of the entire cross-sectional area of the laterally shielded twisted pair taken along any point in the length of the cable.

We provide a high performance twisted pair data cable having a shield laterally wrapped around an unshielded twisted pair cable and a fabric or metal braid or yarn simultaneously or subsequently wrapped around the lateral shield to bind the shield. The wrapping of the shield and binder(the braid or thread) is at a tension such that for an individual twisted pair that may be used on its own, the individual pair has an unfitted impedance that has a nominal or standard impedance deviation for each bound-laterally shielded twisted pair cable that is rated for up to 600 MHz a standard impedance deviation of 3.5 or less from 1.0 to 600 MHz and with no single impedance deviation being greater than 6.0, and for a cable rated for up to 1000 MHz a standard impedance deviation 4.5 or less from 1.0–1000 MHz and with no single impedance deviation being greater than 6.0. The high-performance data cable which has a plurality of bound-laterally shielded twisted pair cables and is rated at up to 600 MHz has an average standard impedance deviation for all of the plurality of bound-shielded twisted of pairs of 3.5 or less from 1.0 to 600 MHz and with no single standard deviation for any of the cables being greater than 6.0. The high-performance data cable which has a plurality of bound-laterally shielded twisted pair cables and is rated at up to 1000 MHz has an average standard impedance deviation for all of the plurality of bound-laterally shielded twisted pairs of and 4.5 or less from 1.0–1000 MHz and with no single standard deviation for any of the cables being greater than 6.0. The standard impedance deviation is calculated around a mean or average impedance of 50 to 200 ohms and with at least 350 frequency measurement taken on a 328 ft. or longer cable.

Also, we provide a high performance data cable that has the ability to be labeled as a UL910 high performance data plenum cable. This cable preferably has a non-fluorinated jacket and a temperature-resistant flame-retardant separator tape beneath and in contact with the jacket.

Other advantages of the invention will become more apparent upon reading the following preferred description taken in conjunction with the drawings.

DETAILED DESCRIPTION OF THE PREFERRED EMBODIMENTS

Figure 1:
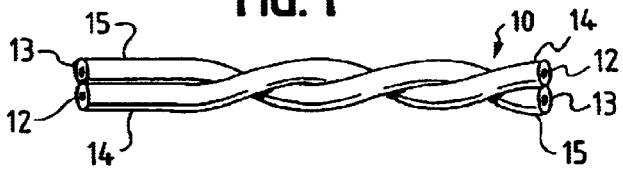
FIG. 1 is a perspective view of a twisted pair cable used in the present invention.

FIG. 1 illustrates a twisted pair cable 10 having a pair of conductors 12 and 13 which are preferably solid copper conductors but can be any conductor that is suitable for high performance data cables. Each of the conductors 12 and 13 have extruded thereon an appropriate insulation 14 and 15 which may be foamed or non-foamed fluorocopolymer or an appropriate polyolefin.

Figure 2:
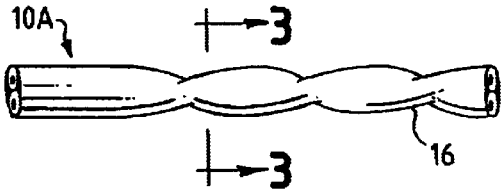
FIG. 2 is a perspective view of a lateral shielded twisted pair cable according to the present invention.

FIG. 2 illustrates the twisted pair of FIG. 1, tightly wrapped with a metal shield 16. The metal shield can be any appropriate shield such as a metal tape or a composite tape with a non-metal base such as a polyester (i.e. MYLAR) having on one or both sides of the non-metal base a metal normally used in cable shields. The metal for the tape and the composite tape being aluminum, copper, copper alloy, nickel, silver, etc. The thickness of the overall metal is 0.33 to 2.0 mil and preferably 1.0 mil. The shield is a metal shield such as, the short fold BELDFOIL type tapes, or the DUOFOIL type tapes which is a tape where metal is on both sides of the tape.

Figure 3:
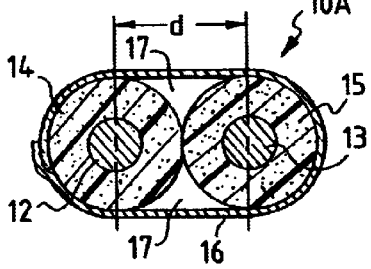
FIG. 3 is an enlarged cross-section taken along lines 3—3 of FIG. 2.

The tape 16 is laterally wrapped with sufficient pressure as shown in FIG. 3 so as not to crush the insulation 14 and 15 but to provide a small void space 17 that is less than 25% of the cross-sectional area shown in FIG. 3. Preferably the void space is less than 18% of the cross-sectional area shown in FIG. 3. The tightly wrapped tape 16 conforms to the outer shape of the twisted pair 10 to provide the laterally shielded twisted pair cable 10A. The tape 16 is wrapped with a slight overlap and with an optional short fold. As noted above, the preferred thickness of the aluminum or metal is 1 mil. The width of the tape is sufficient to provide a 10% minimum overlap.

Figure 4A:
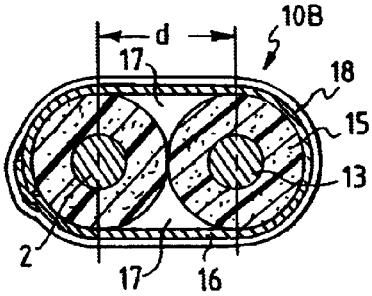
FIG. 4A is an enlarged cross-section of a braided lateral shielded twisted pair cable according to the present invention.
Figure 4B:
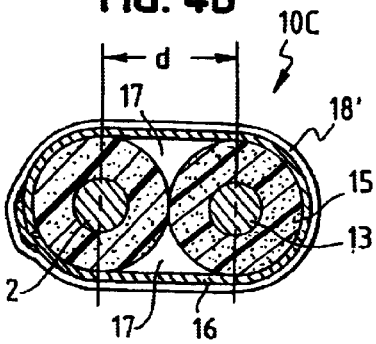
FIG. 4B is an enlarged cross-section of a thread bound lateral shielded twisted pair cable according to the present invention.

As shown in FIGS. 4A and 4B, the shielded twisted pair cable 10A (FIG. 3) is tightly held together by a binder 18 or 18' to provide the bound-shielded cables 10B and 10C. The tension on the tape and binder wrap is sufficiently tight to conform to the contours of the unshielded twisted pair 10 to provide a substantially oval cross-section configuration but is not so tight that it will deform the insulation 14 and 15. The lateral wrapping and binding are done at such a tension that it eliminates substantially most of the air within the bound shielded twisted pair cables 10B and 10C. This provides at any point in the length of the cable, a tight oval cross-section with voids 17. This tight wrapping provides the standard impedance deviation and the average standard impedance deviation noted above.

The insulation is preferably a foamed fluorocopolymer having a thickness of 0.010–0.060 inches and preferably 0.015 to 0.020 inches. The individual conductors 12 and 13 are generally 20 to 30 AWG and preferably 22 to 24 AWG.

The conductors can be solid or stranded and are preferably solid. The lay length for all of the four twisted pair cables 10 may be the same or different and right and/or left hand. The lay is preferably 0.3–2.0 inches. The overall cable lay is generally 10 to 20 times the cable's average core diameter.

The binder 18 is either a fabric (i.e., Aramid) or metal braid which is preferably a 40–95% braid. The metal is preferably a 45–65% tinned copper braid but can be any type metal braid that would be appropriate for a high performance cable such as category 7 data cable i.e. copper, copper alloy, bronze (a copper alloy which alloying element is other than nickel or zinc), silver, etc.

The binder 18' is a fabric thread (Aramide) that is helically wrapped to provide a 40–95% binding. We preferably use an Aramid 760 denier thread having a ¼ inch helical lay.

Figure 5:
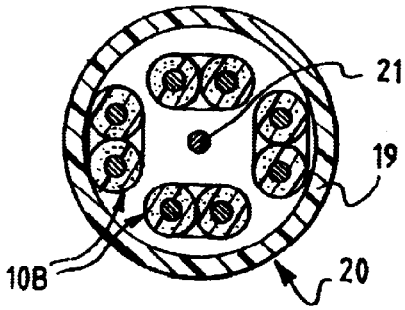
FIG. 5 is a cross-section of a cable containing four of the cables of FIG. 4A.

Referring to FIG. 5, the bound shielded cable 10B or 10C has a jacket 19 extruded thereover to produce the high performance data cable 20 of the present invention. The jacket can be any suitable cable jacket material that would be suitable for a category 7 cable—a thermoplastic such as flame retardant polyethylene, polyvinyl chloride, fluorocopolymers, etc.

Figure 6:
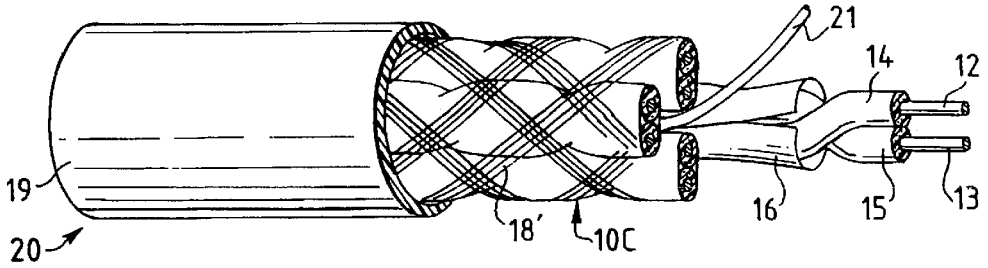
FIG. 6 is a perspective view of the cable of FIG. 5.

FIG. 6 illustrates a cable 20 having therein four braided-shielded twisted pair cables 10B. An optional ground wire 21 is between the cables 10B. The ground wire of course can be located in any suitable location such as just under the jacket and/or used to bundle the four braided-shielded cables 10B.

Figure 7:
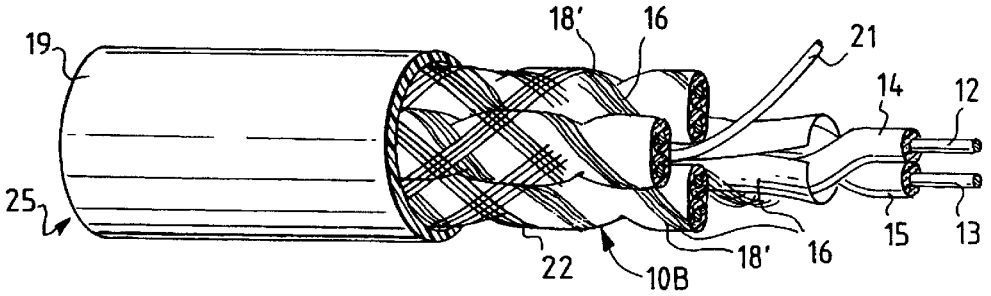
FIG. 7 is a perspective view of a cable containing four of the cables of FIG. 4B.

FIG. 7 illustrates a cable 25 having therein the four thread bound-shielded twisted pair cables 10C. The four thread bound-shielded twisted pair cables 10C are further wrapped or bundled with a metal or fabric braid 22. The braid 22 is generally the same type as that set forth above for braid 18. An optional ground wire 21 is between the cables 10C. As above, the ground wire of course can be located in any suitable location such as just under the jacket and/or used to bundle the four thread bound-shielded cables 10C.

Figure 8:
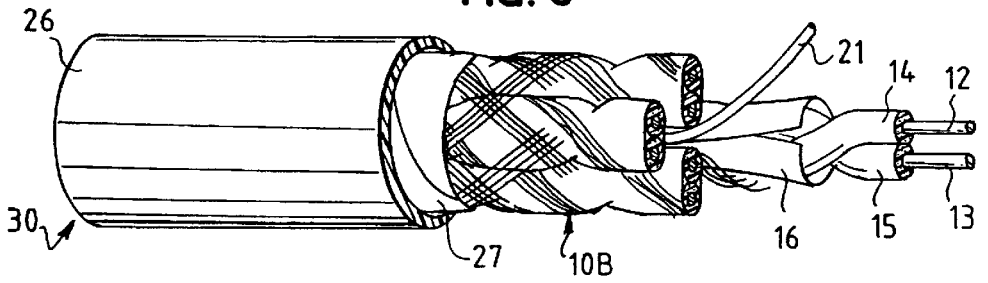
FIG. 8 is a perspective view of one of our plenum UL910 high performance data cables.

FIG. 8 illustrates a cable 30 having a jacket 26, a helically or laterally wrapped separator tape 27 below the jacket. The separator tape 27 surrounds the four twisted pair thread bound-shielded cables 10C and their binding braid 22. The jacket 26 is a non-fluorinated jacket such as polyvinyl chloride. The separator tape 27 is a temperature-resistant flame retardant separator tape such as Nomex®. The construction of this cable is similar to the cable of FIG. 7 except this cable has the separator tape 27 and does not have a fluorinated jacket. When desired, the plurality of these non-metal braided or serve shielded twisted pair cables can be bundled or wrapped by the ground wire 21. The bundled twisted pair cables then have the separator tape placed thereover and the jacket 26 extruded thereover.

As its shown in our following examples 1–7, the high performance braided lateral shielded twisted pair cables have an unfitted impedance that has a standard impedance deviation for cables rated up to 600 MHz, of 3.5 or less when taking at least 350 measurements of from 1.0 to 600 MHz and for cables rated up to 1000 MHz, of 4.5 or less when taking at least 350 measurements from 1.0–1000 MHz. The high-performance data cables which have a plurality of the braided-shielded twisted pair cables has an average standard impedance deviation for all of the plurality of braided-shielded twisted pairs of 3.5 or less from 1.0 to 600 MHz and 4.5 or less from 1.0–1000 MHz and no single standard impedance deviation is greater than 6.0. The test for all of the Examples was the impedance tests as required by CENELEC and were conducted on 328 ft. lengths of bound-shielded twisted pair cables wherein the shield was laterally wrapped to provide the twisted pair cables 10A. The lateral shield was a BELDFOIL tape having a 1 mil aluminum thickness. The tape was laterally wrapped with a slight overlap. The lateral tape was bound with a metal braid. Measurements started at 0.3 MHz and at least three hundred and fifty (350) measurements were taken from about 1 to 600 MHz for Examples 1 and 8 and from about 1.0 to 1000 MHz for Examples 2–7. The cable conductors 12 and 13 were 22 AWG solid copper and the insulations 14 and 15 were FEP. The measurements were taken at various temperatures and adjusted to 20° C. All of the cables have a void 17 of less than 18% and the test were taken around the mean impedance close to 100 ohms.

EXAMPLE 1

A 328 ft. length of the above braided-shielded twisted pair cable 10B was tested at 23.3° C. The cable impedance was measured over 0.3 to 600 MHz and at least 350 measurements were taken between 1.0 and 600 MHz. The braided-shielded twisted pair cable was tested and had a standard impedance deviation of 1.7714 taken around a mean impedance of 95.2619.

EXAMPLE 2

A 328 ft. length of the above braided-shielded twisted pair cable 10B was tested at 23.3° C. The cable impedance was measured over 0.3 to 1000 MHz and at least 350 measurements were taken between 1.0 and 1000 MHz. The braided-shielded twisted pair cable was tested and had a standard impedance deviation of 2.8565 taken around a mean impedance of 94.3178.

EXAMPLE 3

A 328 ft. length of the above high-performance data cable 20 having four braided-shielded twisted pair cables 10B was tested at 23.9° C. The impedance for each of the four braided-shielded twisted pair cables was measured over 0.3 to 1000 MHz. At least 350 measurements were taken between 1.0 and 1000 MHz. The following data was adjusted to 20° C.

The first braided-shielded twisted pair cable had a standard impedance deviation of 4.2744 taken around a mean impedance of 100.5321.

The second braided-shielded twisted pair cable had a standard impedance deviation of 5.1630 taken around a mean impedance of 101.4416.

The third braided-shielded twisted pair cable had a standard impedance deviation of 4.0469 taken around a mean impedance of 101.4583.

The fourth braided-shielded twisted pair cable had a standard impedance deviation of 4.3360 taken around a mean impedance of 100.7506.

The high-performance cable 20 of this example had an average standard impedance deviation of 4.4551 ((4.2744+5.1630+4.0469+4.3360)/4).

EXAMPLE 4

A 328 ft. length of the above high-performance data cable 20 having four braided-shielded twisted pair cables 10B was tested at 23.9° C. The impedance for each of the four braided-shielded twisted pair cables was measured over 0.3 to 1000 MHz. At least 350 measurements were taken between 1.0 and 1000 MHz. The following data was adjusted to 20° C.

The first braided-shielded twisted pair cable had a standard impedance deviation of 4.0430 taken around a mean impedance of 101.1783.

The second braided-shielded twisted pair cable had a standard impedance deviation of 4.0027 taken around a mean impedance of 101.3086.

The third braided-shielded twisted pair cable had a standard impedance deviation of 3.6038 taken around a mean impedance of 101.7716.

The fourth braided-shielded twisted pair cable had a standard impedance deviation of 4.0092 taken around a mean impedance of 101.3598.

The high-performance cable 20 of this example had an average standard impedance deviation of 3.9147 ((4.0430+4.0027+3.6038+4.0092)/4).

EXAMPLE 5

A 328 ft. length of the above high-performance data cable 20 having four braided-shielded twisted pair cables 10B was tested at 23.9° C. The impedance for each of the four braided-shielded twisted pair cables was measured over 0.3 to 1000 MHz. At least 350 measurements were taken between 1.0 and 1000 MHz. The following data was adjusted to 20° C.

The first braided-shielded twisted pair cable had a standard impedance deviation of 3.2469 taken around a mean impedance of 199.2035.

The second braided-shielded twisted pair cable had a standard impedance deviation of 4.2070 taken around a mean impedance of 100.9596.

The third braided-shielded twisted pair cable had a standard impedance deviation of 3.4690 taken around a mean impedance of 102.8214.

The fourth braided-shielded twisted pair cable had a standard impedance deviation of 3.8990 taken around a mean impedance of 101.2338.

The high-performance cable 20 of this example had an average standard impedance deviation of 3.7055 ((3.2469+4.2070+3.4690+3.8990)/4).

EXAMPLE 6

A 328 ft. length of the above high-performance data cable 20 having four braided-shielded twisted pair cables 10B was tested at 24.2° C. The impedance for each of the four braided-shielded twisted pair cables was measured over 0.3 to 1000 MHz. At least 350 measurements were taken between 1.0 and 1000 MHz. The following data was adjusted to 20° C.

The first braided-shielded twisted pair cable had a standard impedance deviation of 4.0488 taken around a mean impedance of 101.4423.

The second braided-shielded twisted pair cable had a standard impedance deviation of 4.2081 taken around a mean impedance of 100.9498.

The third braided-shielded twisted pair cable had a standard impedance deviation of 4.5567 taken around a mean impedance of 102.0121.

The fourth braided-shielded twisted pair cable had a standard impedance deviation of 3.6408 taken around a mean impedance of 102.9531.

The high-performance cable 20 of this example had an average standard impedance deviation of 4.1136 ((4.0488+4.2081+4.5567+3.6408)/4).

EXAMPLE 7

A 328 ft. length of the above high-performance data cable 20 having four braided-shielded twisted pair cables 10B was tested at 24.2° C. The impedance for each of the four braided-shielded twisted pair cables was measured over 0.3 to 1000 MHz. At least 350 measurements were taken between 1.0 and 1000 MHz. The following data was adjusted to 20° C.

The first braided-shielded twisted pair cable had a standard impedance deviation of 3.6939 taken around a mean impedance of 102.0776.

The second braided-shielded twisted pair cable had a standard impedance deviation of 3.8658 taken around a mean impedance of 100.4614.

The third braided-shielded twisted pair cable had a standard impedance deviation of 3.5208 taken around a mean impedance of 99.7808.

The fourth braided-shielded twisted pair cable had a standard impedance deviation of 3.9835 taken around a mean impedance of 100.0594.

The high-performance cable 20 of this example had an average standard impedance deviation of 3.7660 ((3.6939+3.8658+3.5208+3.9835)/4).

EXAMPLE 8

A 328 ft. length of the above high-performance data cable 20 having four braided-shielded twisted pair cables 10B was tested at 24.4° C. The impedance for each of the four braided-shielded twisted pair cables was measured over 0.3 to 600 MHz. At least 350 measurements were taken between 1.0 and 600 MHz. The following data was adjusted to 20° C.

The first braided-shielded twisted pair cable had a standard impedance deviation of 3.5621 taken around a mean impedance of 102.2971.

The second braided-shielded twisted pair cable had a standard impedance deviation of 3.9185 taken around a mean impedance of 103.9484.

The third braided-shielded twisted pair cable had a standard impedance deviation of 2.6943 taken around a mean impedance of 103.2519.

The fourth braided-shielded twisted pair cable had a standard impedance deviation of 2.5206 taken around a mean impedance of 102.9625.

The high-performance cable 20 of this example had an average standard impedance deviation of 3.1739 ((3.5621+3.9185+2.6943+2.5206)/4).

EXAMPLE 9

Two cables of FIG. 8 were UL 910 tested. Each cable had four twisted pair thread bound-shielded cables 10C. Each of the cables shields 16 was a 2 mils aluminum/0.5 mills polyester tape having a 0.625 inch width. Each of the shields 16 were bound with an Aramid 760 thread. The four thread bound-shielded cables were wrapped with a 40% tinned copper braid. The four braid bundled cables were wrapped with a 2 mils Nomex separator tape having a 1.250 inch width. Over the separated tape was an extruded polyvinyl chloride jacket. Both cables passed the UL 910 plenum test. During the UL 910 plenum test, the first cable registered a flame of 1.5 ft., a 0.32 Peak and a 0.09 Avg P/F. The second cable registered a flame of 1.5 ft., a 0.29 Peak and a 0.09 Avg P/F. Both cables would be rated as category 7 cables with a rating of up to 1000 MHz.

Although our invention for the UL 910 plenum at least category 5 high-performance data cable was UL 910 tested on the cable of FIG. 8 which is a category 7 cable, it is understood that our invention is to be considered as not being limited to this specific construction of the cable but is directed to any category 5 or higher cable utilizing a non-fluorinated jacket such as a polyvinyl chloride jacket and between the jacket and cable core there is a temperature-resistant flame-retardant separator tape. For instance we provide a UL 910 plenum high-performance data cable having a rating of up to 600 MHz that has the structure disclosed in our co-pending application, which are tightly wrapped helical shielded twisted pair cables, and utilizing in that cable a non-fluorinated jacket such as a polyvinyl chloride jacket and between the jacket and cable core, a temperature-resistant flame-retardant separator tape. Our UL 910 plenum at least category 5 high-performance data cable is not limited to the cables just mentioned above but is for UL 910 plenum at least category 5 high-performance data cable that has a non-fluorinated jacket and between the jacket and cable core, a temperature-resistant flame-retardant separator tape.

It will, of course, be appreciated that the embodiments which have just been described have been given by way of illustration, and the invention is not limited to the precise embodiments described herein. Various changes and modifications may be effected by one skilled in the art at without departing from the scope or spirit of the invention as defined in the appended claims.

We claim:

1. An individual bound lateral shielded twisted pair data cable comprising:

an insulated twisted pair cable, a shielding tape selected from the group consisting of a metal tape, a first composite tape having a non-metal base and a layer of metal on one side of said base, and a second composite tape having a non-metal base and a layer of metal on both sides of said base;

said shielding tape being laterally wrapped with at least a 10% overlap around said individual twisted pair cable;

a fabric or metal binder being wrapped around said shielding tape to provide a bound lateral shielded twisted pair cable;

said shielding tape having a metal thickness of 0.33 to 2.00 mils;

said shielding tape and binder being wrapped around said twisted pair at a tension to eliminate a substantial amount of the air and to leave a cross-sectional void area of less than 25% of the cross-sectional area of the shielded twisted pair cable to provide said bound lateral shielded twisted pair data cable; and to provide said bound lateral shielded twisted pair data cable with an adjusted to 20° C. standard impedance deviation of 4.5 or less when said standard deviation is calculated around a mean or average impedance of 50 to 200 ohms.

2. The cable of claim 1 wherein, said cable has a rating out to 1000 MHz., and said standard deviation is measured on a 328 ft. or longer cable with at least 350 frequency measurements taken from 1.0 to 1000 MHz and calculated around a mean or average impedance of 90 to 110 ohms.

3. The cable of claim 2 wherein said cross-sectional void area is less than 18%, and said shielding tape has a metal thickness of 0.75 to 1.25 mils.

4. The cable of claim 1 wherein, said cable has a rating out to 600 MHz, and said impedance deviation is measured on a 328 ft. or longer cable with at least 350 frequency measurements taken from 1.0 to 600 MHz and said standard impedance deviation is 3.5 or less and calculated around a mean or average impedance of 90 to 110 ohms.

5. The data cable of claim 3 wherein said cross-sectional void area is less than 18%, and said shielding tape has a metal thickness of 0.75 to 1.25 mils.

6. The cable of claim 1 further comprising at least four of said individually bound lateral shielded twisted pair cables, a jacket surrounding said at least four bound lateral shielded twisted pair cables to provide a high performance data cable; and said high performance data cable having an adjusted to 20° C. average standard impedance deviation of 4.5 or less when taken on a 328 ft. or longer said average standard impedance deviation is the average of the standard impedance deviation measured on each of said at least four bound lateral shielded twisted pair cables, the standard impedance deviation is measured on each of said at least four bound lateral shielded twisted pair cables with at least 350 frequency measurements taken and calculated around a mean or average impedance of 50 to 200 ohms.

7. The cable of claim 6 wherein said high performance data cable is rated at least out to 600 MHz, each of said at least four bound lateral shielded twisted pair cables has a cross-sectional void area of less than 18%, said high performance data cable has an adjusted to 20° C. average standard impedance deviation of 3.5 or less when taken on a 328 ft. or longer high performance data cable, the standard impedance deviation is measured on each of said at least four bound-shielded twisted pair cables with at least 350 frequency measurements from 1.0 to 600 MHz and calculated around a mean or average impedance of 90 to 110 ohms, and no single standard impedance deviation is greater than 6 from said mean or average impedance.

8. The cable of claim 6 wherein, high performance data cable is rated at least out to 1000 MHz, each of said at least four bound lateral shielded twisted pair cables has a cross-sectional void area of less than 18%, said high performance data cable has an adjusted to 20° C. average standard impedance deviation of 4.5 or less when taken on a 328 ft. or longer high performance data cable, the standard impedance deviation is measured on each of said at least four bound-shielded twisted pair cables with at least 350 frequency measurements from 1.0 to 1000 MHz and calculated around a mean or average impedance of 90 to 110 ohms, and no single standard impedance deviation is greater than 6 from said mean or average impedance.

9. The cable of claim 6 wherein, a temperature-resistant flame-retardant separator tape surrounds said at least four bound lateral shielded twisted pair cables and is between said jacket and a cable core, and said jacket is a non-fluorinated polyolefin.

10. The cable of claim 6 wherein said high performance data cable is rated at least out to 600 MHz, each of said at least four bound lateral shielded twisted pair cables has a cross-sectional void area of less than 18%, said high performance data cable has an adjusted to 20° C. average standard impedance deviation of 3.5 or less when taken on a 328 ft. or longer high performance data cable, the standard impedance deviation is measured on each of said at least four bound-shielded twisted pair cables with at least 350 frequency measurements from 1.0 to 600 MHz and calculated around a mean or average impedance of 90 to 110 ohms, and no single standard impedance deviation is greater than 6 from said mean or average impedance.

a temperature-resistant flame-retardant separator tape surrounds said at least four bound lateral shielded twisted pair cables and is between said jacket and a cable core, and said jacket is a non-fluorinated polyolefin.

11. The cable of claim 6 wherein, said high performance data cable is at least rated out to 1000 MHz, each of said at least four bound lateral shielded twisted pair cables has a cross-sectional void area of less than 18%, said high performance data cable has an adjusted to 20° C. average standard impedance deviation of 4.5 or less when taken on a 328 ft. or longer high performance data cable, the standard impedance deviation is measured on each of said at least four bound lateral shielded twisted pair cables with at least 350 frequency measurements from 1.0 to 1000 MHz and calculated around a mean or average impedance of 90 to 110 ohms, and no single standard impedance deviation is greater than 6 from said mean or average impedance.

a temperature-resistant flame-retardant separator tape surrounds said at least four bound lateral shielded twisted pair cables and is between said jacket and a cable core, and said jacket is a non-fluorinated polyolefin.

12. A UL 910 plenum high performance data cable comprising a cable core containing at least four twisted pair cables, each of the said twisted pair cables being laterally shielded and bound to provide at least four bound lateral shielded twisted pair cables, a temperature-resistant flame retardant separator tape surrounds the at least four bound lateral shielded twisted pair cables, said separator tape being between said jacket and a cable core, and said jacket is a non-fluorinated polyolefin wherein said separator tape is wrapped around the twisted pair at a tension to eliminate a substantial amount of the air and to leave a cross sectional void area of less than 25% of the cross sectional area of the shielded twisted pair cables to provide the bound lateral shielded twisted pair cable and to provide the bound lateral shielded twisted pair cable with an adjusted 20° C. standard impedance deviation of 4.5 or less when said standard deviation is calculated around a mean or average impedance of 50 to 200 ohms.

13. The cable of claim 12 wherein said cable is at least rated out to at least 600 MHz, and said high performance data cable has an adjusted to 20° C. average standard impedance deviation of 3.5 or less when taken on a 328 ft. or longer high performance data cable, the standard impedance deviation is measured on each of said at least four pairs of cables with at least 350 frequency measurements from 1.0 to 600 MHz and calculated around a mean or average impedance of 90 to 110 ohms, and no single standard impedance deviation is greater than 6 from said mean or average impedance.

14. The cable of claim 12 wherein said cable is rated out to at least 1000 MHz, said high performance data cable has an adjusted to 20° C. average standard impedance deviation of 4.5 or less when taken on a 328 ft. or longer high performance data cable, the standard impedance deviation is measured on each of said at least four pairs of cables with at least 350 frequency measurements from 1.0 to 1000 MHz and calculated around a mean or average impedance of 90 to 110 ohms, and no single standard impedance deviation is greater than 6 from said mean or average impedance.

15. A method of preparing an individual bound lateral twisted pair data cable comprising:

providing a twisted pair cable having an insulation selected from the group consisting of foamed or non-foamed fluorocopolymer and polyolefin;

laterally wrapping said twisted pair cable with a metal shielding tape to provide a lateral shielded twisted pair cable with at least a 10% overlap of said shielding tape and said shielding tape having a metal thickness of 0.33 to 2.00 mils, and said shielding tape being selected from the group consisting of a metal tape, a first composite tape having a non-metal base and a layer of metal on one side of said base, and a second composite tape having a non-metal base and a layer of metal on both sides of said base;

wrapping said lateral shielded twisted pair cable with a fabric or metal binder to provide a bound lateral shielded twisted pair cable; and wrapping the lateral metal shield and binder at a tension to provide said bound lateral shielded twisted pair cable with an adjusted to 20° C. standard impedance deviation of 4.5 or less when said standard impedance deviation is measured on a 328 ft. or longer cable with at least 350 frequency measurements being taken and the standard impedance being calculated around a mean or average impedance of 50 to 200 ohms.

16. The method of claim 15 wherein said shielding tape has a metal thickness of 0.75 to 1.25 mils, wrapping and binding the twisted pair cables so that said cross-sectional void area is less than 18%, and said cable having a rating out to 600 MHz, said at least 350 frequency measurements are taken from 1.0 to 600 MHz, and said standard deviation is 3.5 or less and calculated around a mean or average impedance of 90 to 110 ohms and no single deviation is greater than 6 from said mean or average impedance.

17. The method of claim 15 wherein said shielding tape has a metal thickness of 0.75 to 1.25 mils, wrapping and binding the twisted pair cables so that said cross-sectional void area is less than 18%, and said cable having a rating out to 1000 MHz, said at least 350 frequency measurements taken from 1.0 to 1000 MHz, and said standard deviation is 4.5 or less and calculated around a mean or average impedance of 90 to 110 ohms and no single deviation is greater than 6 from said mean or average impedance.

18. The method of claim 15 further comprising bundling at least four of said bound lateral shielded twisted pair cables, extruding a jacket over the at least four individually bound lateral shielded twisted pair bundled cables to provide a high performance data cable, and selecting said at least four individually bound lateral shielded twisted pair cables to provide said high performance data cable with a rating out to 600 MHz, an average standard impedance deviation of 3.5 or less when taken on a 328 ft. or longer high performance data cable wherein a standard impedance deviation is measured on each of said at least four bound lateral shielded twisted pair cables with at least 350 frequency measurements and taken and calculated around a mean or average impedance of 90 to 110 ohms, and said average standard impedance deviation is the average of said standard impedance deviation measured on all of said at least four bound lateral shielded twisted pair cables.

19. The method of claim 18 further comprising prior to extruding the jacket, wrapping a heat-resistant flame-retardant separator tape around at least four bound lateral shielded twisted pair cables such that the temperature-resistant flame-retardant separator tape is between said jacket and a cable core, and said jacket is a non-fluorinated polyolefin.

20. The method of claim 15 further comprising bundling at least four of said individually bound lateral shielded twisted pair cables, extruding a jacket over the at least four bound lateral shielded twisted pair bundled cables to provide a high performance data cable, and selecting said at least four bound lateral shielded twisted pair cables to provide said high performance data cable with a rating out to 1000 MHz, an average standard impedance deviation of 4.5 or less taken when on a 328 ft. or longer high performance data cable wherein a standard impedance deviation is measured on each of said at least four bound lateral shielded twisted pair cables with at least 350 frequency measurements and taken and calculated around a mean or average impedance of 90 to 110 ohms, and said average standard impedance deviation is the average of said standard impedance deviation measured on all of said at least four bound lateral shielded twisted pair cables.

21. The method of claim 20 further comprising prior to extruding the jacket, wrapping said heat-resistant flame-retardant tape around said at least four bound lateral shielded twisted pair cables such that the temperature-resistant flame-retardant separator tape surrounds is between said jacket and a cable core, and said jacket is a non-fluorinated polyolefin.

* * * * *